US009332333B2

(12) United States Patent
Akino

(10) Patent No.: US 9,332,333 B2
(45) Date of Patent: May 3, 2016

(54) MICROPHONE AND WIND SCREEN

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/636,576

(22) Filed: Mar. 3, 2015

(65) Prior Publication Data

US 2015/0304754 A1 Oct. 22, 2015

(30) Foreign Application Priority Data

Apr. 17, 2014 (JP) ..... 2014085185

(51) Int. Cl.
*H04R 9/08* (2006.01)
*H04R 1/08* (2006.01)
*H04R 1/02* (2006.01)

(52) U.S. Cl.
CPC ..... *H04R 1/086* (2013.01); *H04R 1/028* (2013.01)

(58) Field of Classification Search
CPC .... H04R 1/086; H04R 1/028; F21V 33/0052; A61B 7/04
See application file for complete search history.

(56) References Cited

U.S. PATENT DOCUMENTS 5,289,355 A * 2/1994 Cimock ..... A63J 17/00 362/109
5,603,652 A * 2/1997 Rothschild ..... A63H 3/28 446/130
7,306,347 B2 * 12/2007 Selover ..... F21V 33/0052 362/806
2015/0092975 A1 * 4/2015 Akino ..... H04R 1/08 381/355

FOREIGN PATENT DOCUMENTS

JP 716490 U 3/1995
JP 09093679 A 4/1997
JP 2558249 Y2 12/1997

* cited by examiner

*Primary Examiner* — Tuan D Nguyen
(74) *Attorney, Agent, or Firm* — Whitham Curtis Christofferson & Cook, PC

(57) ABSTRACT

A simple microphone which can vary the direction of the light beams emitted from a ring lamp is provided. A microphone includes a ring lamp; and a light guide that receives incident light beams emitted from the ring lamp. The light guide includes a plurality of light-guiding portions that receive the light beams. The light guide is movable relative to the ring lamp. The light guide moves for selection of the light-guiding portion to receive the light beams and vary the direction of the light beams.

14 Claims, 10 Drawing Sheets

MICROPHONE AND WIND SCREEN

BACKGROUND OF THE INVENTION

1. Technical Field

The present invention relates to a microphone and a wind screen.

2. Background Art

Microphones used in conference rooms are gooseneck microphones, for example. Some gooseneck microphones include ring lamps for indicating the operating state of the microphone. The term "operating state of the microphone" herein refers to the ON/OFF state of the microphone, for example. In the ON state, the microphone transmits sound to a device, such as a speaker, connected to the microphone. In the OFF state, the microphone does not transmit sound signal to the device connected to the microphone.

FIG. 10 is a cross-sectional view of the outline of a conventional gooseneck microphone. A microphone 16 includes a microphone unit 2, a light emitter 3, a ring lamp 4, a wind screen 105, a front storage unit 6, a rear storage unit 7, and a gooseneck 10.

The front storage unit 6 is a metal cylinder that accommodates the microphone unit 2. The front storage unit 6 is connected to part of the outer circumferential surface of the ring lamp 4.

The rear storage unit 7 is connected to the gooseneck 10. The rear storage unit 7 is connected to part of the outer circumferential surface of the ring lamp 4. The front storage unit 6 and the rear storage unit 7 are both connected to the ring lamp 4. The front storage unit 6 supports the light emitter 3 such that the light emitter 3 positions inside the ring lamp 4. The front storage unit 6 and the rear storage unit 7 define a gap 8 therebetween, through which the ring lamp 4 is visible to the exterior of the microphone 16.

The ring lamp 4 is composed of plastic. Specifically, the ring lamp 4 is composed of polypropylene or an elastomer. The light emitter 3 is disposed in a central hole in the ring lamp 4. The light emitter 3 emits light beams that illuminate the entire ring lamp 4. The light emitted from the ring lamp 4 is visible through the gap 8 to the exterior of the microphone 16.

The ring lamp 4 has a large-diameter portion 41 disposed in the middle area of the outer surface along the axial direction. The large-diameter portion 41 protrudes into the gap 8. The large-diameter portion 41, as well as the ring lamp 4, radiates light beams emitted from the light emitter 3.

The illumination of the ring lamp 4 can notify the operating state of the microphone 16. For instance, a meeting may be conducted by participants and assistants. The assistants include a mixer operator who operates a mixer that controls the signals from multiple microphones and a photographer who photographs the meeting. The illumination of the ring lamp 4 constantly notifies the mixer operator of the microphone in use and allows the photographer to readily identify the speaker. The participants can confirm the ON/OFF state of the microphone through the illumination of the ring lamp 4.

In some cases, the participants and the assistants may visibly confirm the illumination of the ring lamp 4 from different directions. For example, the participants may confirm the illumination of the ring lamp 4 visible through the wind screen 105 of the microphone 16 (i.e., through the front of the microphone 16). In contrast, the assistants may confirm the illumination of the ring lamp 4 visible through the gooseneck 10 of the microphone 16 (i.e., through the rear of the microphone 16).

A microphone 16 with a ring lamp 4 of which illumination is visible by a participant through the front of the microphone 16 irradiates the participant's face with light beams emitted from the ring lamp 4. Thus, it is preferred that the ring lamp 4 do not emit light beams in the front direction of the microphone 16 when the participant is photographed.

The ring lamp 4 of the microphone 16 is required to emit light beams in different directions depending on the use of the microphone 16.

Desired is a microphone which can vary the direction of light beams emitted from the ring lamp.

For example, a conventional microphone has been disclosed that includes a light emitter disposed inside a wind screen and a case (for example, Japanese Unexamined Utility Model Application Publication No. 7-16490 (hereinafter, PTL 1)).

Another conventional microphone has been disclosed that includes multiple light emitters accommodated in a window grille (for example, Japanese Unexamined Patent Application Publication No. 9-93679 (hereinafter, PTL 2)).

PTL 1 and PTL 2 do not disclose a microphone that can vary the direction of light beams emitted from a ring lamp.

Registered Utility Model No. 2558249 (hereinafter, PTL 3) discloses a microphone including an optical indicator that can deflect the visible light from the optical indicator.

The optical indicator according to PTL 3, which emits light beams in a predetermined direction, does not include a ring lamp. The object of PTL 3 disclosing the optical indicator differs from an object of the present invention disclosing a microphone that can vary the direction of light beams emitted from the ring lamp.

SUMMARY OF THE INVENTION

Technical Problem

An object of the present invention is to provide a simple microphone and wind screen that can vary the direction of the light beams emitted from a ring lamp of a microphone.

Solution to Problem

A microphone according to an embodiment of the present invention includes a ring lamp; and a light guide that receives light beams emitted from the ring lamp, the light guide having light-guiding portions, the light-guiding portions being configured to receive the light beams, the light guide being movable relative to the ring lamp, the light guide being configured to move for selection of a light-guiding portion to receive the light beams and vary the direction of the light beams.

A wind screen of a microphone according to an embodiment of the present invention includes a main body; and a light guide, the microphone including a ring lamp, the ring lamp emitting light beams that are incident on the light guide, the light guide comprising light-guiding portions that receive the light beams, the light guide being movable relative to the ring lamp, the light guide varying the direction of the light beams through selection of the light-guiding portion to receive the light beams.

Advantageous Effects of Invention

The present invention can provide a simple microphone that can vary the direction of the light beams emitted from a ring lamp. Such a microphone can appropriately notify the user of the ON/OFF state of the microphone in operation depending on the usage conditions of the microphone.

DESCRIPTION OF THE PREFERRED EMBODIMENT

A microphone and a wind screen according to embodiments of the present invention will now be described with reference to the accompanying drawings.

First Embodiment of Microphone

A microphone according to a first embodiment of the present invention will now be described.

Figure 1:
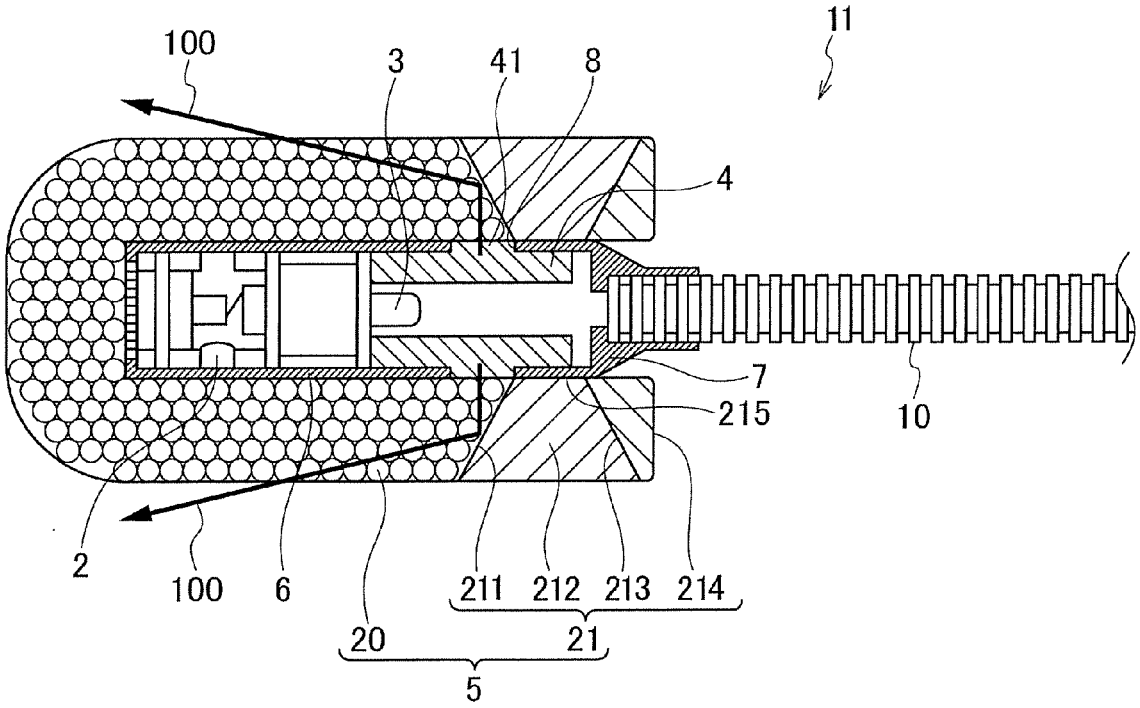
FIG. 1 is a longitudinal cross-sectional view of a microphone according to a first embodiment of the present invention.

With reference to FIG. 1, a microphone 11 includes a microphone unit 2, a light emitter 3, a ring lamp 4, a wind screen 5, a front storage unit 6, a rear storage unit 7, and a gooseneck 10.

The microphone 11 is an electret condenser microphone.

Alternatively, the microphone 11 may be any other microphone, such as a condenser microphone or a dynamic microphone.

Configuration of Microphone Unit 2, Light Emitter 3, Ring Lamp 4, Front storage unit 6, and Rear storage unit 7

With reference to FIG. 1, the front storage unit 6 is a metal cylinder that accommodates the microphone unit 2. The front storage unit 6 is connected to an upper portion of the outer circumferential surface of the ring lamp 4. The microphone 11 has a front for picking up sounds and a rear located opposite to the front.

The rear storage unit 7 is connected to the gooseneck 10. The rear storage unit 7 is connected to a lower portion of the outer circumferential surface of the ring lamp 4. The front storage unit 6 and the rear storage unit 7 are both connected to the ring lamp 4. The front storage unit 6 supports the light emitter 3 such that the light emitter 3 positions inside the ring lamp 4. The front storage unit 6 and the rear storage unit 7 define a gap 8 therebetween, through which the ring lamp 4 is visible to the exterior of the microphone 11.

A representative example of the light emitter 3 is a light-emitting diode. Multiple light emitters 3 may be provided.

The multiple light emitters 3 may emit light beams in different colors. Selective switching of the light emitters 3 that emit light beams in different colors can achieve the illumination of the ring lamp 4 in multiple colors.

The ring lamp 4 is composed of plastic and is irradiated with light beams emitted from the light emitter 3. The light emitter 3 is disposed in a central hole in the ring lamp 4. The light emitter 3 radiates light beams that illuminate the entire ring lamp 4. The light beams emitted from the ring lamp 4 are visible through the gap 8.

Figure 2:
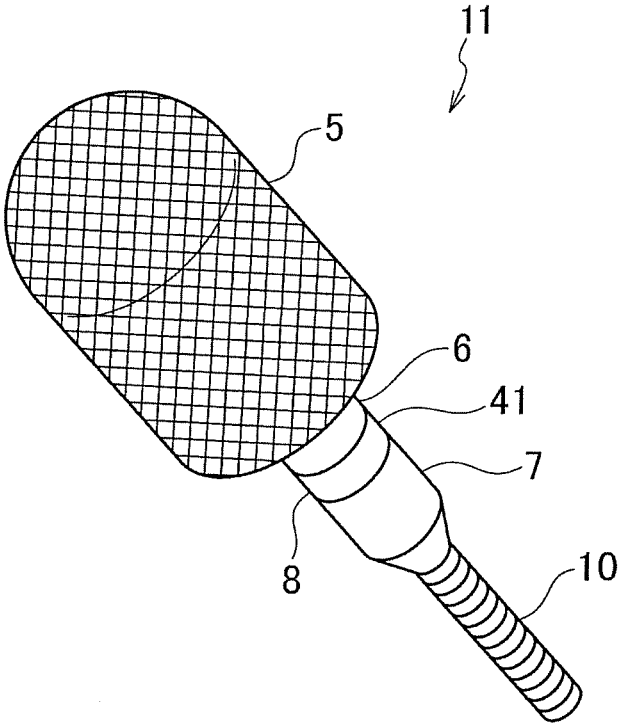
FIG. 2 is a perspective view of the microphone illustrated in FIG. 1.

With reference to FIG. 2, the front storage unit 6 and the rear storage unit 7 defines the gap 8 therebetween. A light guide 21, which is described below, is not shown in FIG. 2.

The ring lamp 4 has a large-diameter portion 41 disposed in the middle area of the outer surface along the axial direction. The large-diameter portion 41 protrudes into the gap 8. In other words, the large-diameter portion 41 is disposed between the front storage unit 6 and the rear storage unit 7. The large-diameter portion 41 is composed of the same material as that for the ring lamp 4 and is illuminated with the light from the light emitter 3.

The ring lamp 4 may be colorless or colored. The ring lamp 4 which is colored can transmit colored light beams through the gap 8.

Configuration of Wind Screen 5

The configuration of the wind screen 5 will now be described. The wind screen 5 is a cap covering the microphone unit 2. The wind screen 5 reduces noise generated by wind applied to the microphone unit 2. The wind screen 5 functions as an acoustic resistor.

Figure 3:
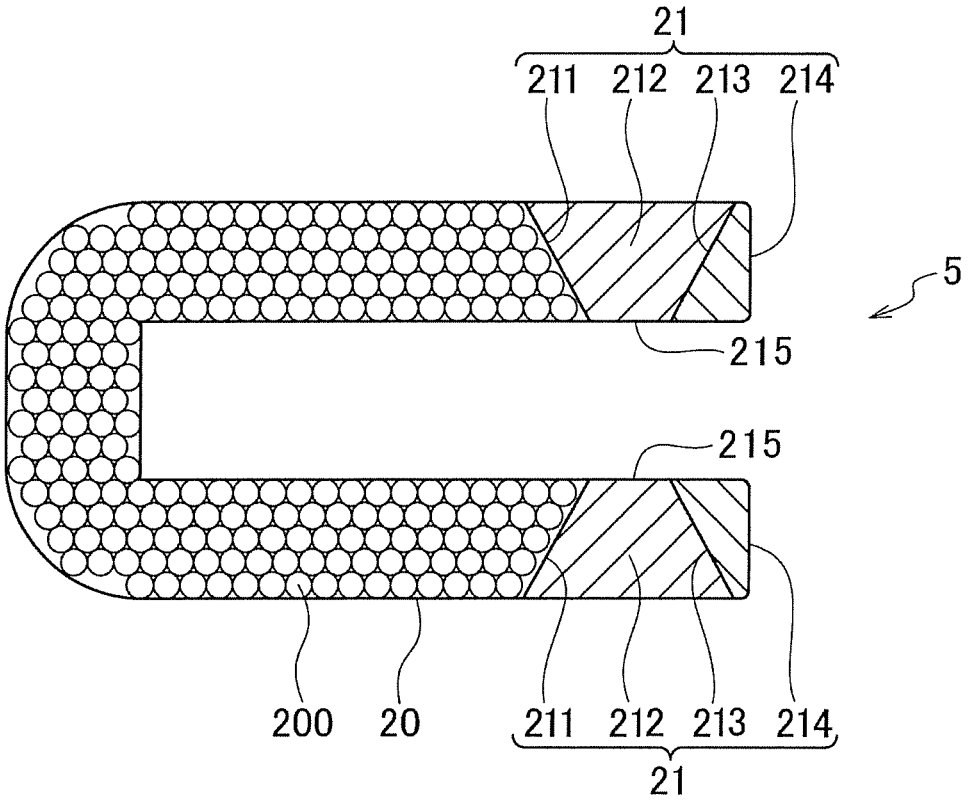
FIG. 3 is a longitudinal cross-sectional view of a wind screen according to an first embodiment of the present invention.

With reference to FIG. 3, the wind screen 5 includes a main body 20 and a light guide 21, which is connected to the main body 20.

The main body 20 is composed of light-transmissive spherical particles 200 that are sintered. Thus, the main body 20 has light transmissivity.

Light beams 100 emitted from the ring lamp 4 are visible through the wind screen 5 having the main body 20 composed of the light-transmissive spherical particles 200 (i.e., visible through the front of the microphone 11).

Alternatively, the main body 20 may be composed of pulverized and sintered light-transmissive resin.

The main body 20 may be colorless or colored.

The wind screen 5 may include a sponge layer composed of urethane foam and disposed between the main body 20 and the front storage unit 6. This sponge layer functions as an acoustic resistor.

The internal sponge layer in the main body 20 facilitates adjustment of acoustic resistance. The wind screen 5 with such a sponge layer exhibits superior wind-noise cancelation for the microphone 11 to a wind screen without a sponge layer. The wind screen 5 including the sponge layer in the interior of the main body 20 has higher weather resistance than a conventional wind screen including a sponge layer in the exterior of the main body 20.

Configuration of Light Guide 21

The configuration of the light guide 21 will now be described. The light guide 21 has a ring shape and can vary the direction of light beams emitted from the ring lamp 4 to a predetermined direction.

With reference to FIG. 3, the light guide 21 is connected to the lower end of the main body 20.

The light guide 21 includes a first light-guiding portion 211, a second light-guiding portion 212, a third light-guiding portion 213, and a fourth light-guiding portion 214.

The first light-guiding portion 211, the second light-guiding portion 212, the third light-guiding portion 213, and the fourth light-guiding portion 214 are optical elements which receive incident light beams emitted from the ring lamp 4.

The first light-guiding portion 211 and the third light-guiding portion 213 are mirrors. The first light-guiding portion 211 and the third light-guiding portion 213 can be fabricated through vacuum deposition of aluminum, for example. The first light-guiding portion 211 is disposed on the contact surface between the second light-guiding portion 212 and the main body 20. The third light-guiding portion 213 is disposed on the contact surface between the second light-guiding portion 212 and the fourth light-guiding portion 214.

The first light-guiding portion 211 has a conical surface with a concave center in view from the front (in view from the left in FIG. 1). The third light-guiding portion 213 has a conical surface with a concave center in view from the rear (in view from the right in FIG. 1).

The second light-guiding portion 212 and the fourth light-guiding portion 214 are composed of a light-transmissive material. The second light-guiding portion 212 and the fourth light-guiding portion 214 are composed of polymethylmethacrylate (PMMA), for example.

The second light-guiding portion 212 is a ring having a substantially trapezoidal longitudinal cross-section and the inner circumference defining the surface area smaller than that of the outer circumference. The inner circumferential surface of the second light-guiding portion 212 consists of a light-transmissive surface 215. The fourth light-guiding portion 214 is a truncated cone having a cylindrical hole in the middle thereof. The fourth light-guiding portion 214 has a substantially triangular longitudinal cross-section.

With reference to FIG. 1, the light guide 21 surrounds the rear storage unit 7. The rear storage unit 7 passes through the central hole in the light guide 21. The light guide 21 is movable along the outer surfaces of the front storage unit 6, the rear storage unit 7, and the large-diameter portion 41 of the ring lamp 4. Specifically, the light guide 21 can slide in the longitudinal direction of the ring lamp 4 along the outer surfaces of the front storage unit 6, the rear storage unit 7, and the large-diameter portion 41 of the ring lamp 4. The light guide 21 thus sequentially comes into contact with the rear storage unit 7, the large-diameter portion 41, and the front storage unit 6. These contact positions serve as switching positions.

The light guide 21 is held at each switching position by contact friction between the surface of the light guide 21 and the front storage unit 6, the rear storage unit 7, or the large-diameter portion 41.

The light guide 21 and the switching positions each may be provided with protrusions or depressions. For example, either the surface of the light guide 21 or the outer circumferential surface of the front storage unit 6 may have a protrusion, and the other a depression. The engagement between the protrusion and the depression on the outer circumferential surfaces of the light guide 21 and the front storage unit 6 can precisely adjust and certainly hold the position of the light guide 21 relative to the ring lamp 4. Alternatively, the light guide 21 may have any other known sliding mechanism, such as a spring sliding mechanism.

Relationship between Light Guide 21 and Light Beams 100, 101, and 102

The light beams 100, 101, and 102 are emitted from the ring lamp 4.

FIG. 1 illustrates the light guide 21 disposed at a first position. At the first position, light beams emitted from the large-diameter portion 41 of the ring lamp 4 are incident on the main body 20.

When the light guide 21 lies at the first position, the light beams 100 are emitted radially outward through the main body 20 and are incident on the first light-guiding portion 211. The light beams 100 are reflected at the first light-guiding portion 211 in the front direction of the microphone 11. The light beams 100 reflected at the first light-guiding portion 211 pass through the main body 20. The light beams 100 passing through the main body 20 are irregularly reflected at the spherical particles 200 in the main body 20. This causes the light beams 100 to diffuse throughout the entire main body 20.

When the light guide 21 lies at the first position, the first light-guiding portion 211 reflects the light beams 100 emitted from the ring lamp 4 in the front directions of the microphone 11. Thus, the illumination of the ring lamp 4 is visible to the participants and assistants on the front of the microphone 11.

Figure 4:
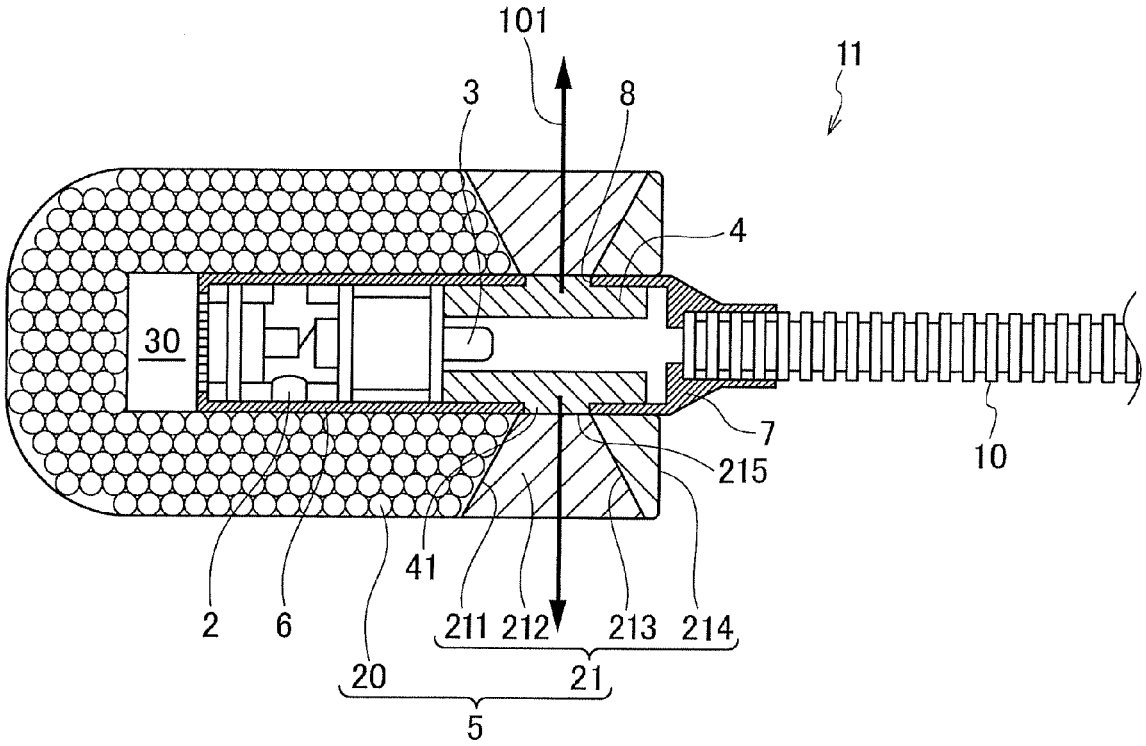
FIG. 4 is a longitudinal cross-sectional view of the microphone according to the first embodiment, the microphone including a light guide disposed at a second position.

FIG. 4 is a longitudinal cross-sectional view of the microphone 11. FIG. 4 illustrates the light guide 21 disposed at a second position. At the second position, the light beams emitted from the large-diameter portion 41 are incident on the light-transmissive surface 215.

The main body 20 moves together with the light guide 21. Thus, the light guide 21 at the second position forms a space 30 between the main body 20 and the front storage unit 6.

When the light guide 21 lies at the second position, the light beams 101 pass through the light-transmissive surface 215 and are incident on the second light-guiding portion 212. The second light-guiding portion 212 transmits the light beams 101 in the lateral directions of the microphone 11.

That is, when the light guide 21 lies at the second position, the second light-guiding portion 212 transmits the light beams 101 in the lateral directions of the microphone 11. Thus, the illumination of the ring lamp 4 is visible to the participants and assistants on the lateral sides of the microphone 11.

Figure 5:
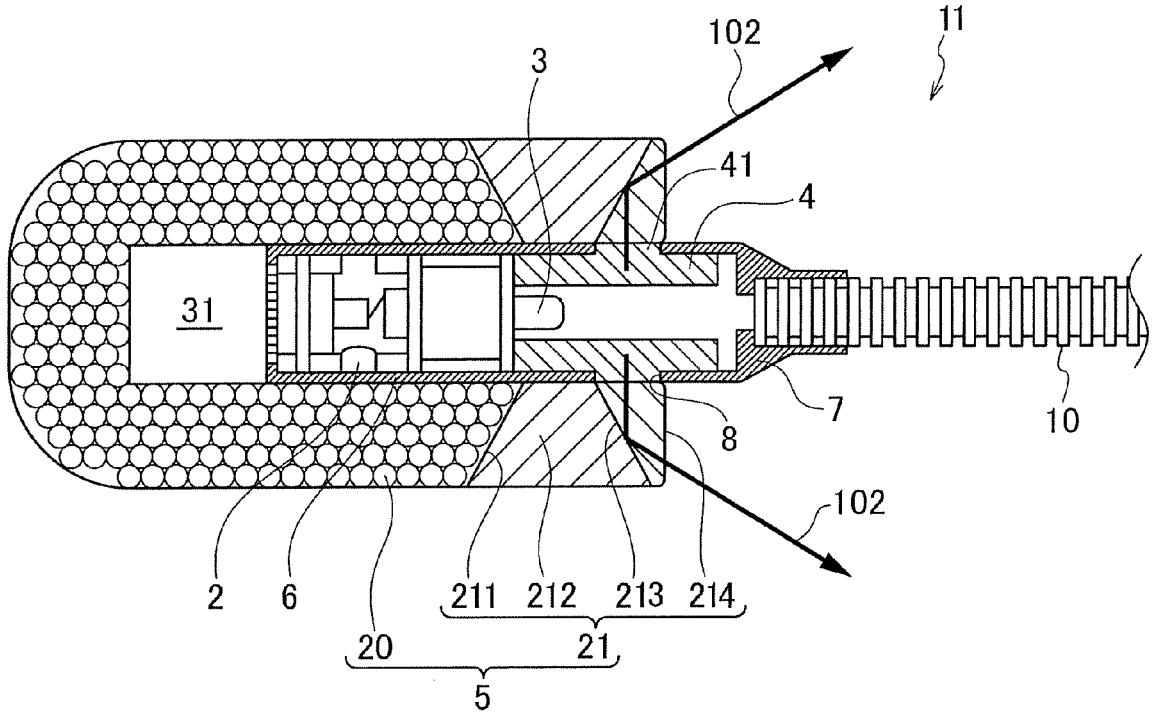
FIG. 5 is a longitudinal cross-sectional view of the microphone according to the first embodiment, the microphone including the light guide disposed at a third position.

FIG. 5 is a longitudinal cross-sectional view of the microphone 11. FIG. 5 illustrates the light guide 21 disposed at a third position. At the third position, light beams 102 emitted from the large-diameter portion 41 of the ring lamp 4 are incident on the fourth light-guiding portion 214.

The main body 20 moves together with the light guide 21. Thus, a space 31 is formed between the main body 20 and the front storage unit 6. This space 31 is larger than the space 30.

When the light guide 21 lies at the third position, the light beams 102 are incident on the third light-guiding portion 213. The light beams 102 are reflected at the third light-guiding portion 213 to pass through the fourth light-guiding portion 214. The fourth light-guiding portion 214 transmits the light beams 102 radially outward in the rear directions of the microphone 11.

That is, when the light guide 21 lies at the third position, the third light-guiding portion 213 reflects the light beams 102 in the rear directions of the microphone 11. Thus, the illumination of the ring lamp 4 is visible to the participants and assistants on the rear of the microphone 11.

As described above, the light beams 100 from the first light-guiding portion 211, the light beams 101 from the second light-guiding portion 212, and the light beams 102 from the third light-guiding portion 213 emit in different directions one another.

According to the first embodiment described above, the movement of the light guide 21 varies the direction of the light beams emitted from the ring lamp 4. That is, the microphone has a simple configuration that can vary the direction of the light beams emitted from the ring lamp.

The microphone according to the first embodiment described above is a monaural microphone. Alternatively, the microphone according to the present invention may be a stereo microphone.

Second Embodiment of Microphone

A microphone according to a second embodiment of the present invention will now be described. Features differ from those of the embodiment described above will be mainly described. Unlike the embodiment described above, this embodiment does not include the second light-guiding portion 212.

Figure 6:
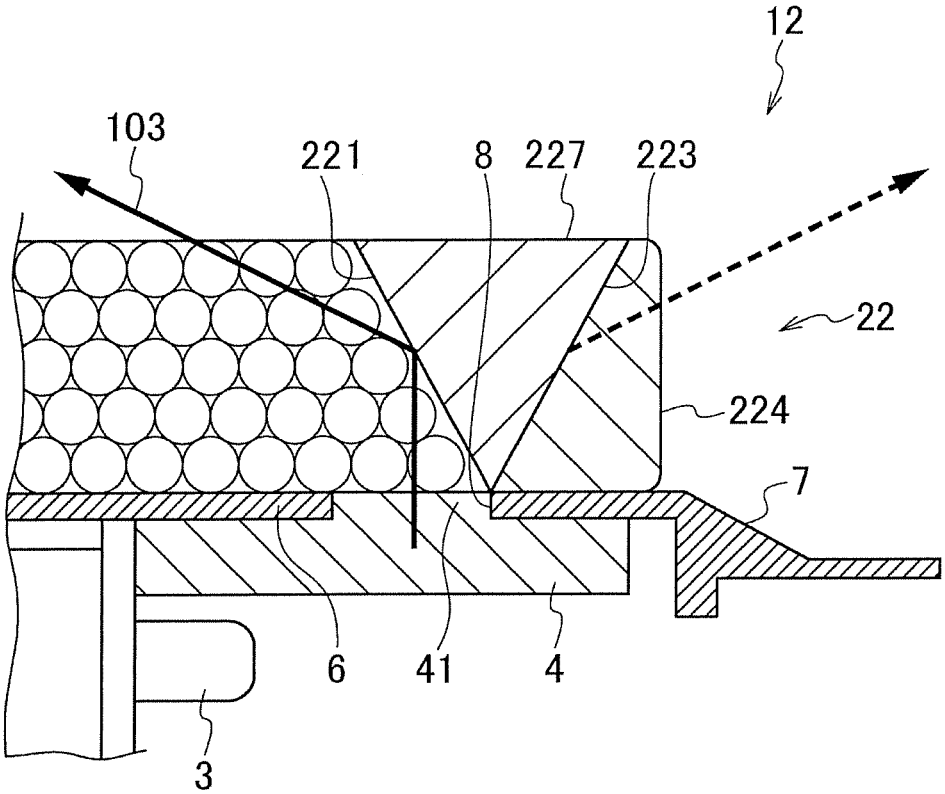
FIG. 6 is an enlarged longitudinal cross-sectional view of part of a microphone according to a second embodiment of the present invention.

With reference to FIG. 6, a microphone 12 includes a light guide 22. The light guide 22 includes a first light-guiding portion 221, a third light-guiding portion 223, and a fourth light-guiding portion 224. That is, unlike the light guide 21 of the microphone of the first embodiment, the light guide 22 does not include the second light-guiding portion 212.

A support 227 is disposed between the first light-guiding portion 221 and the third light-guiding portion 223 to support these portions. The support 227 has a substantially triangular longitudinal cross-section. That is, the light guide 22 according to this embodiment is like the light guide 21 but without the light-transmissive surface 215. The support 227 may be composed of any material.

When the first light-guiding portion 221 is positioned such that light beams 103 emitted from the large-diameter portion 41 of the ring lamp 4 are incident on the first light-guiding portion 221, the light beams 103 pass through the wind screen 5 in the front direction of the microphone 12. In contrast, when the fourth light-guiding portion 224 is positioned such that the light beams 103 enter the fourth light-guiding portion 224, the light beams 103 pass through the fourth light-guiding portion 224 and are reflected at the third light-guiding portion 223 in the direction indicated by the dashed arrow in FIG. 6, i.e., in the rear direction of the microphone 12.

In the microphone 12, the direction of the light beams emitted from the ring lamp 4 can be readily switched between the front direction and the rear direction of the microphone 12 by moving the light guide 22.

The light guide 22 may be movable to a position at the middle of the large-diameter portion 41 along the longitudinal direction of the ring lamp 4. At this position, the light beams 103 from the ring lamp 4 are incident on both the first light-guiding portion 221 and the fourth light-guiding portion 224. This can illuminate the entire microphone 12.

Third Embodiment of Microphone

A microphone according to a third embodiment of the present invention will now be described. Features differ from those the embodiments described above will be mainly described. A light guide 23 in this embodiment is like the light guide 21 in the embodiments described above but without the third light-guiding portion 213.

Figure 7:
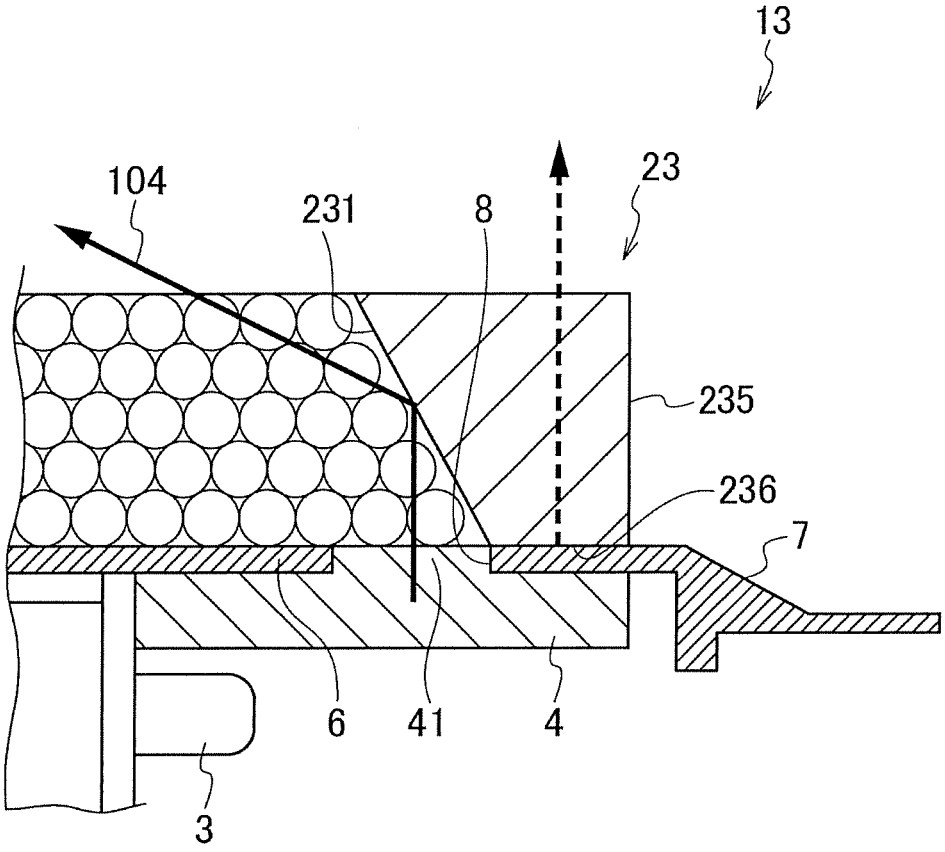
FIG. 7 is an enlarged longitudinal cross-sectional view of part of a microphone according to a third embodiment of the present invention.

With reference to FIG. 7, a microphone 13 includes a light guide 23. The light guide 23 includes a first light-guiding portion 231 and a fifth light-guiding portion 235. The shape of the fifth light-guiding portion 235 is the same as that of an integration of the second light-guiding portion 212 and the fourth light-guiding portion 214 in the light guide 21 of the microphone according to the first embodiment. In other words, unlike the light guide 21, the light guide 23 does not include the third light-guiding portion 213.

The fifth light-guiding portion 235 is composed of a light-transmissive material, such as polymethylmethacrylate (PMMA). The inner circumferential surface of the fifth light-guiding portion 235 is a light-transmissive surface 236.

When the light guide 23 is positioned such that light beams 104 emitted from the large-diameter portion 41 of the ring lamp 4 are incident on the first light-guiding portion 231, the light beams 104 pass through the wind screen 5 in the front direction of the microphone 13. In contrast, when the light guide 23 is positioned such that the light beams 104 are incident on the fifth light-guiding portion 235, the light beams 104 pass through the light-transmissive surface 236 and the fifth light-guiding portion 235 in the direction indicated by the dashed arrow in FIG. 7, i.e., in the lateral directions of the microphone 13.

In the microphone 13, the direction of the light beams emitted from the ring lamp 4 can be readily switched between the front direction and the lateral direction of the microphone 13 by moving the light guide 23.

Fourth Embodiment of Microphone

A microphone according to forth embodiment of the present invention will now be described. Features differ from those of the embodiments described above will be mainly described. Unlike the embodiments described above, this embodiment includes a shield 32 that blocks light beams in place of the fourth light-guiding portion 214.

Figure 8:
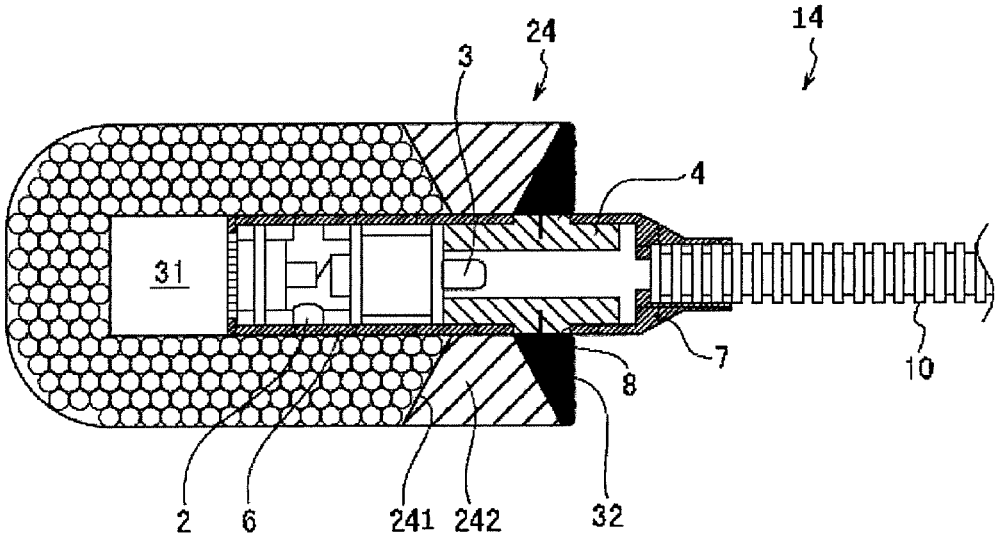
FIG. 8 is a longitudinal cross-sectional view of a microphone according to fourth embodiment of the present invention.

With reference to FIG. 8, a microphone 14 includes a light guide 24. The light guide 24 includes a first light-guiding portion 241, a second light-guiding portion 242, and a shield 32. The shield 32 is a truncated cone having a cylindrical hole in the middle thereof. The shield 32 has a substantially triangular longitudinal cross-section. That is, the shape of the shield 32 is similar to that of the fourth light-guiding portion 214 of the light guide 21 of the microphone according to the first embodiment.

The shield 32 is composed of, for example, a non-light transmissive resin.

When the light guide 24 is positioned such that the light beams emitted from the large-diameter portion 41 are incident on the shield 32, the light beams emitted from the ring lamp 4 are blocked. Thus, the light beams emitted from the ring lamp 4 do not exit the light guide 24.

In the microphone 14 including the light guide 24 having the shield 32, the light beams emitted from the ring lamp 4 can be readily switched between a visible state and a non-visible state.

Fifth Embodiment of Microphone

A microphone according to fifth embodiment of the present invention will now be described. Features differ from those of the embodiments described above will be mainly described. Unlike the embodiments described above, this embodiment includes a partial shield 33, which blocks light beams, on part of the circumference of the light guide.

Figure 9:
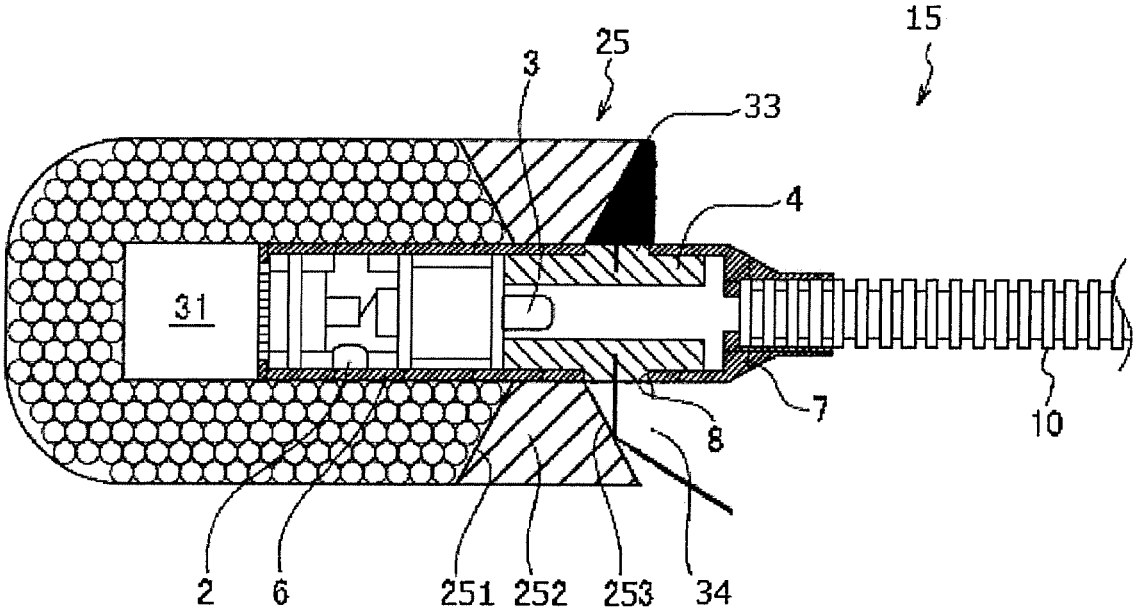
FIG. 9 is a longitudinal cross-sectional view of a microphone according to a fifth embodiment of the present invention.
Figure 10:
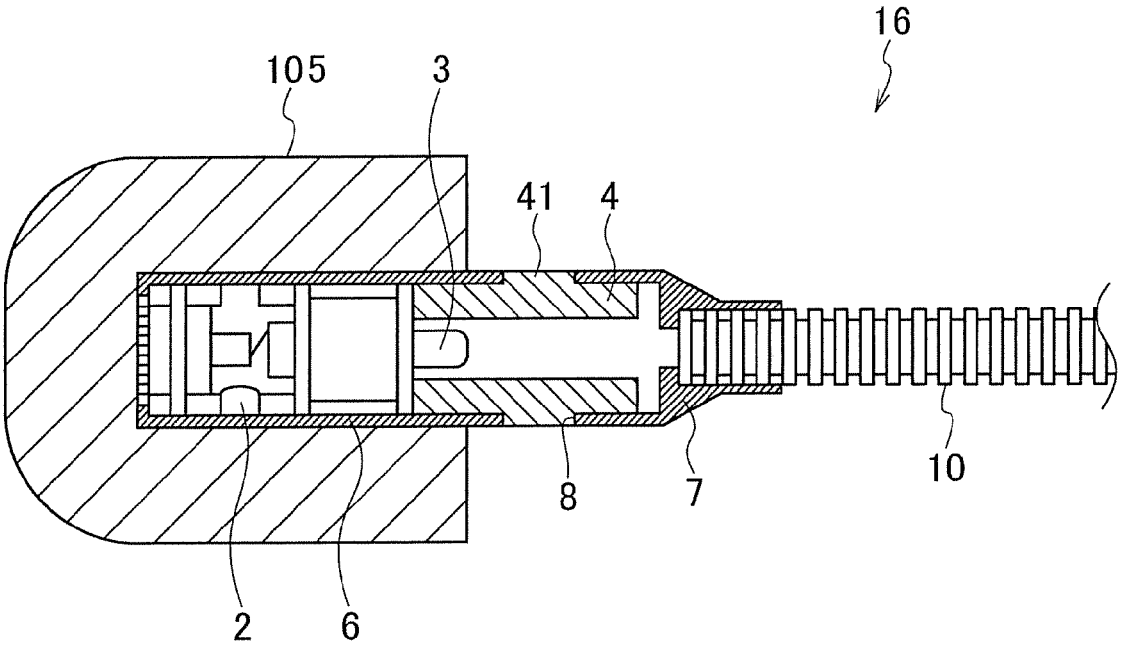
FIG.10 RELATED ART
FIG. 10 is longitudinal cross-sectional view of a conventional microphone.

With reference to FIG. 9, a microphone 15 includes a light guide 25. The light guide 25 includes a first light-guiding portion 251, a second light-guiding portion 252, a third light-guiding portion 253, and a partial shield 33. The partial shield 33 is part of a truncated cone having a cylindrical hole in the middle thereof. The shape of the partial shield 33 is a substantially truncated cone (or the fourth light-guiding portion 214, for example) cut along two planes containing the central axis of the substantially truncated cone and defining a predetermined angle about the central axis.

The partial shield 33 and the third light-guiding portion 253 define a void 34.

A light-guiding portion composed of a light-transmissive material may be disposed in the void 34.

When the partial shield 33 is positioned such that the light beams emitted from the large-diameter portion 41 are incident on the partial shield 33, the light beams emitted from the ring lamp 4 do not pass through the partial shield 33. In contrast, the light beams emitted from the ring lamp 4 pass through the void 34, are reflected at the third light-guiding portion 253, and exit the microphone 15. That is, the light beams emitted from the ring lamp 4 are emitted only in a predetermined circumferential direction of the microphone unit 2.

With reference to FIG. 9, the light beams emitted into the void 34 are reflected diagonally rearward and downward at the third light-guiding portion 253.

The microphone 15 including the light guide 25 having the partial shield 33 can function as a desk lamp that illuminates only a predetermined area (for example, the area around the hands of the speaker using the microphone 15) with the light beams emitted from the ring lamp 4.

In the microphone 15 including the light guide 25 having the partial shield 33, the direction of the light beams emitted from the ring lamp 4 can be readily varied to a predetermined radial direction of the microphone 15.

Alternatively, the light guide 25 may be rotatable in the circumferential direction of the microphone 15.

The light guide 25 rotatable in the circumferential direction of the microphone 15 can vary the direction of the light beams emitted from the ring lamp 4 to a predetermined radial direction of the microphone 15.

The embodiments described above can selectively indicate the ON/OFF state of the microphone. For example, for the confirmation of the ON/OFF state by all participants, the entire wind screen is illuminated. For the confirmation of the ON/OFF state by only the assistants, part of the wind screen is illuminated. The illumination of the wind screen can be switched to the illumination of the rear of the microphone to prevent over-illumination of the speaker's face during video recording of the conference.

What is claimed is:

1. A microphone comprising:
a ring lamp; and
a light guide that receives light beams emitted from the ring lamp, wherein
the light guide having a plurality of light-guiding portions on the circumference of the ring lamp, the light-guiding portions being configured to receive the light beams,
the light guide being movable relative to the ring lamp, and
the light guide being configured to move for selection of a light-guiding portion to receive the light beams and vary the direction of the light beams.

2. The microphone according to claim 1, wherein
the plurality of light-guiding portions comprise:
a first light-guiding portion that receives the light beams; and
a second light-guiding portion that receives the light beams, wherein
the light guide is movable to a first position and a second potion relative to the ring lamp,
the light beams are incident on the first light-guiding portion when the light guide lies at the first position,
the light beams are incident on the second light-guiding portion when the light guide lies at the second position, and
the direction of the light beams emitted from the first light-guiding portion differs from the direction of the light beams emitted from the second light-guiding portion.

3. The microphone according to claim 1, wherein,
the light guide comprises a shield that blocks the light beams, and
the light guide is movable to a third position at which the shield blocks the light beams.

4. The microphone according to claim 3, wherein the shield is disposed on part of the circumference of the light guide.

5. The microphone according to claim 1, wherein the light guide is slidable in the longitudinal direction of the ring lamp.

6. The microphone according to claim 1, wherein at least one of the light-guiding portions comprise a mirror.

7. The microphone according to claim 1, wherein at least one of the light-guiding portions comprise a light-transmissive material.

8. A wind screen comprising:
a main body; and
a light guide connected to the main body,
the main body being configured to be attached to a microphone comprising a ring lamp,
the ring lamp emitting light beams to be incident on the light guide,
the light guide comprising a plurality of light-guiding portions to receive the light beams,
the light guide being movable relative to the ring lamp,
the light guide being configured to move for selection of a light-guiding portion to receive the light beams and vary the direction of the light beams.

9. The wind screen according to claim 8, wherein,
the light guide comprises:
a first light-guiding portion that receives the light beams; and
a second light-guiding portion that receives the light beams, wherein
the light guide is movable relative to the ring lamp to a first position and a second position,
the light beams are incident on the first light-guiding portion when the light guide lies at the first position,
the light beams are incident on the second light-guiding portion when the light guide lies at the second position, and
the direction of the light beams emitted from the first light-guiding portion differs from the direction of the light beams emitted from the second light-guiding portion.

10. The wind screen according to claim 8, wherein,
the light guide comprises a shield that blocks the light beams, and
the light guide is movable to a third position at which the shield blocks the light beams.

11. The wind screen according to claim 10, wherein the shield is disposed on part of the circumference of the light guide.

12. The wind screen according to claim 8, wherein the light guide is slidable along the longitudinal direction of the ring lamp.

13. The wind screen according to claim 8, wherein the main body comprises sintered light-transmissive particles.

14. The wind screen according to claim 8, wherein the main body is movable together with the light guide.

* * * * *